United States Patent [19]

Campbell

[11] 4,293,604

[45] Oct. 6, 1981

[54] FLOCKED THREE-DIMENSIONAL NETWORK MAT

[75] Inventor: Douglas D. Campbell, Minneapolis, Minn.

[73] Assignee: Minnesota Mining and Manufacturing Company, Saint Paul, Minn.

[21] Appl. No.: 168,683

[22] Filed: Jul. 11, 1980

[51] Int. Cl.[3] ..... B32B 5/28

[52] U.S. Cl. ..... 428/90; 428/92; 428/95; 428/97; 428/296; 428/315

[58] Field of Search ..... 428/90, 92, 95, 97, 428/296, 315

[56] References Cited

U.S. PATENT DOCUMENTS

| | | | |
|---|---|---|---|
| 3,496,054 | 2/1967 | Baigas, Jr. | 161/63 |
| 3,837,988 | 9/1974 | Hennen et al. | 161/67 |
| 3,968,283 | 12/1980 | Schutte | 428/90 |

*Primary Examiner*—Marion McCamish

*Attorney, Agent, or Firm*—Cruzan Alexander; Donald M. Sell; Richard Francis

[57] ABSTRACT

A mat formed of a web comprising a resilient three-dimensional network of polymeric material which has been flocked throughout and adhered to a support backing.

11 Claims, 5 Drawing Figures

FLOCKED THREE-DIMENSIONAL NETWORK MAT

DESCRIPTION

1. Technical Field

This invention relates to a mat formed of a web comprising a resilient three-dimensional network of polymeric material which has been flocked throughout and adhered to a support backing.

2. Background Art

Various devices have been employed at the entry ways of buildings to reduce or remove the accumulation of various solid materials (hereinafter referred to merely as "dirt") and water typically found on the feet of persons entering the building. (The term "feet" as used in this context means the shoes of a person wearing shoes or the feet per se of a person not wearing shoes.) Such devices typically include a mat which provides a brushing or wiping action against the feet. Such mats may be used in conjunction with a blade-like device which is first used to scrape heavier deposits of dirt from the feet.

The mats are generally fibrous or fabric in nature to provide the desired frictional surface and wiping action. Most fabric or fibrous mats are not, however, completely satisfactory because they have a very limited capacity for storage of removed dirt and water and most are not particularly conducive to the rapid evaporation of water. They require frequent shaking and washing to rejuvenate the mat for subsequent uses.

Some fabric or fibrous mats are unattractive and/or fail to provide a luxuriant underfoot surface. The more attractive and luxuriant mats are generally formed of very dense fabric pile, providing a surface with only a very limited capacity for the storage of dirt and a structure from which water will be evaporated slowly.

Attempts have been made to provide floor mats which have a greater volume for the storage of accumulated dirt, but these have generally been somewhat less than satisfactory. For example, lengths of solid material such as edgewise oriented pieces of metal or segments of cut up automobile tires have been linked together leaving spaces therebetween to provide for the storage of dirt and other debris. Such mats, however, are not satisfactory because, besides being poor water absorbers, they leave the dirt removed plainly in view and they also require that the dirt be collected and removed after the mat is displaced since such mats generally have no bottom layer.

Several mats are available having both a frictional surface and a bottom layer for collecting the dirt. An example of such a mat consists of a continuous layer of polymeric material which has embossed in one surface thereof a plurality of closely spaced erect resilient projections in circular patterns, the tops of which provide the frictional surface and the adjacent surface of which provides a collection surface for the removed dirt. Such a mat is not particularly suitable, however, because the projections wear rather rapidly and they fail to conceal the collected soil, leaving unsightly residues in plain view.

U.S. Pat. No. 3,496,054 (Baigas, Jr.) discloses a nonwoven batt of thermoplastic textile fibers being surface flocked with textile fibers applied over a resinous adhesive film inwardly to about 10% to about 35% of the thickness of the batt. Such flocking provides a relatively dense surface which, while possibly providing sufficient frictional contact to remove dirt and moisture from the feet, likely would be too dense to permit passage of larger particles of dirt into the mat. Also, since this mat is only surface flocked, the water absorbing capacity would be limited by the slow evaporation from this densely flocked surface.

A particularly useful and commercially successful mat is presently being marketed by the assignee of the present application under the trade designation "Nomad". This mat is described in assignee's U.S. Pat. No. 3,837,988 (Hennen and Kusilek). This mat consists of a resin-bonded web of coarse diameter continuous undulated resilient filaments which may be laminated to a backing layer. Such a product has the advantageous combination of providing a luxuriant, wear-resistant resilient surface capable of providing the appropriate frictional contact, sufficient openness and capacity to accept relatively large quantities of dirt, and sufficient structural body to substantially obscure the collected dirt. Because this product is formed of relatively hydrophobic filaments, it is not a particularly good water absorbing mat. While U.S. Pat. No. 3,837,988 indicates the web may be flocked, there is no indication therein of flocking the web in the manner other than that known in the art, e.g., as exemplified by the aforementioned Baigas patent.

DISCLOSURE OF INVENTION

The present invention provides a flocked mat which is particularly suited for pedestrian traffic. The mat of the invention may be advantageously used at the entry way of a building to wipe wet and/or dirty feet. The mat of the invention overcomes many of the deficiencies noted above, providing a luxuriant, attractive, durable surface capable of wiping feet, receiving, obscuring and holding therein dirt removed from the feet, wiping water from the feet and facilitating evaporation of water.

Generally, the mat of the invention is comprised of a flocked open web which has a continuous backing layer providing one major surface of the mat. The web is formed of a three-dimensional, lofty, open, porous network formed of connected strands of water-resistant, organic polymeric material generally defining connecting open spaces capable of receiving dirt. The web is at least 0.5 cm thick, preferably 1.0 to 2.5 cm thick, has a void volume of at least 75%, preferably 80 to 90%, and is resiliently compressible underfoot by at least 10% of its thickness. The backing is formed of an organic polymeric material as a continuous layer having a thickness on the order of 0.2 to 2.5 mm. A resinous water-resistant bonding adhesive substantially entirely coats the surfaces of the individual strands of the network substantially throughout the web without filling the open spaces. A water-resistant, wear-resistant organic textile flocking material is uniformly distributed substantially throughout the web and adhesively bonded to the web by the resinous bonding adhesive substantially entirely covering the surfaces of the individual strands of the network substantially without filling the open spaces.

The preferred webs are formed of a multiplicity of continuous undulated filaments autogenously bonded together at points of contact, crimped staple fibers adhesively bonded together at points of mutual contact, open looped pile supported on a base layer, or so called reticulated foams.

The flocked mat has sufficient openness to provide open spaces capable of receiving dirt, yet sufficient structure to provide a mat surface which will substantially obscure the visibility of any collected dirt from view by a pedestrian passing over the mat.

The web is flocked with textile fibers substantially throughout its volume, thereby providing minute connecting capillary pathways where water entering the upper surface of the mat, for example, by wiping the shoes, will be dispersed within the mat, rather than being confined to the original entry location or collected as large liquid deposits within the mat. This provides a high surface area for rapid evaporation. Quite unexpectedly, applicant has discovered that when the mat is flocked throughout as thus described, it will absorb significantly more water without impeding impregnation by particulate soil.

BRIEF DESCRIPTION OF DRAWINGS

For convenience in understanding the invention, attention is directed to the accompanying drawing, in which.

BEST MODE FOR CARRYING OUT THE INVENTION

Figure 2:
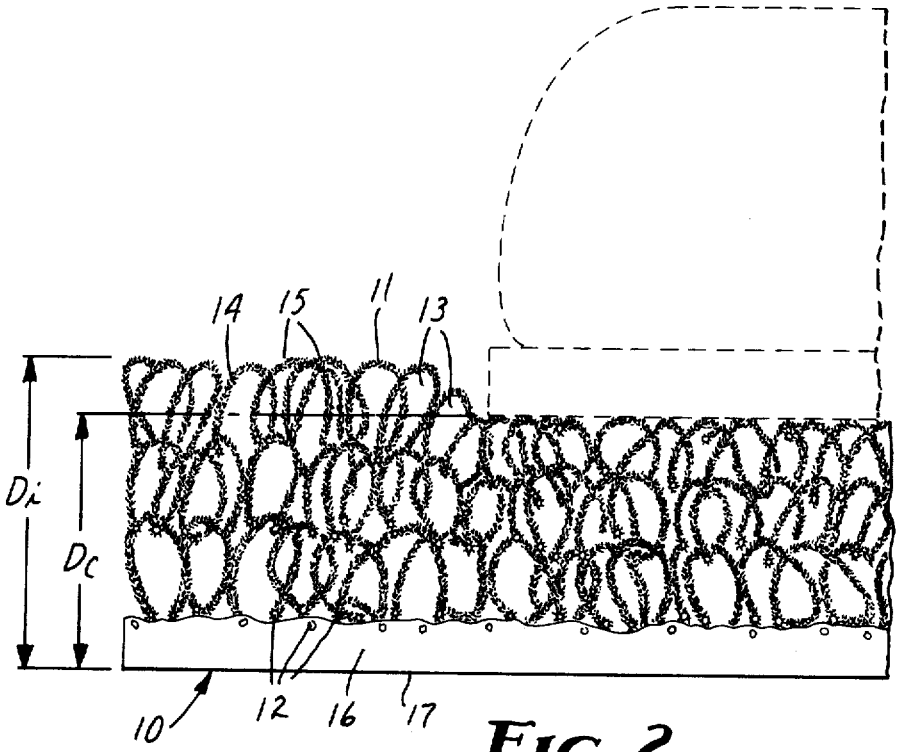
FIG. 2 is a greatly enlarged side view of a segment of the flocked mat of the invention, a part of which is shown as being compressed by the front part of a foot shown in dotted lines.
Figure 3:
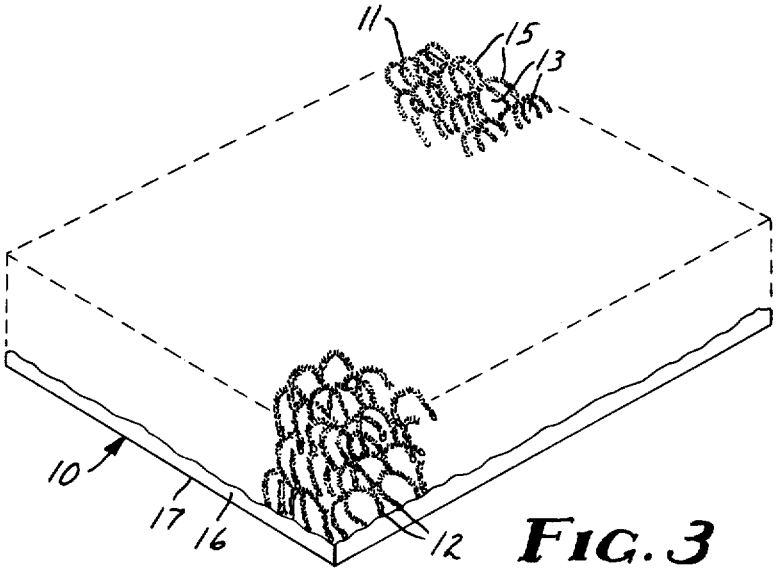
FIG. 3 is a perspective view of a flocked mat of the invention.

As depicted in the drawings, particularly FIGS. 2 and 3, there is shown a flocked mat 10 comprised of a web 11 which is formed of a three-dimensional, lofty, open, porous network formed of preferably connected strands 12 of water-resistant, organic polymeric material. Strands 12 generally define connected open spaces 13 which are capable of receiving dirt. Strands 12 are coated with a resinous water-resistant bonding adhesive 14 which adhesively bonds to the surface of strands 12 water-resistant organic textile flocking fibers 15. A continuous backing layer 16 of organic polymeric material is attached to one major surface of web 11 forming one major surface 17 of mat 10.

Figure 1:
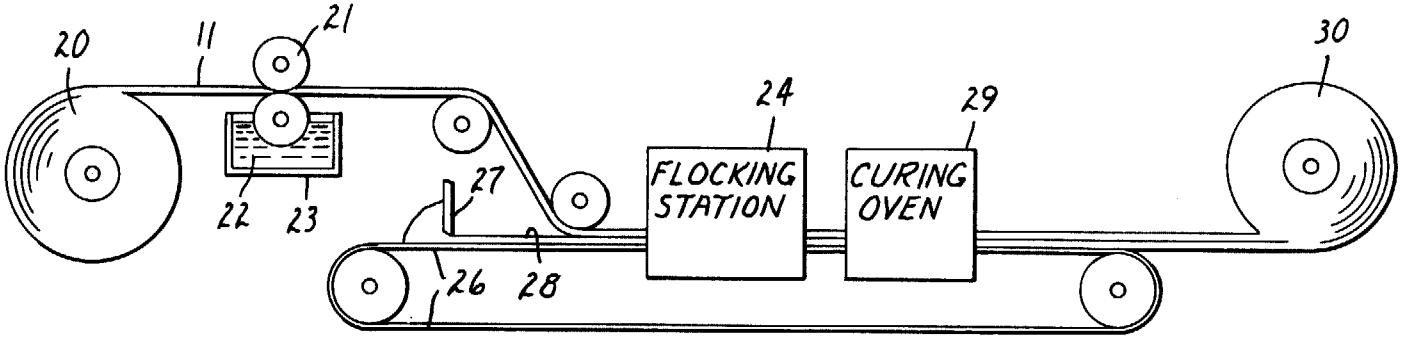
FIG. 1 represents a schematic view of a process for producing the flocked mat of the present invention.
Figure 5:
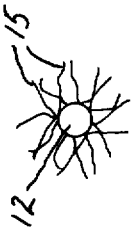
FIG. 5 is an enlarged cross sectional view of a flocked filament of the flocked mat of the invention, showing the flock fibers in a random array.
Figure 4:
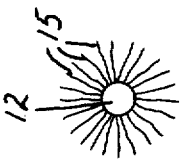
FIG. 4 is an enlarged cross sectional view of a flocked filament of a flocked mat, showing the flocked fibers in a radial array.

The mat of the invention may be produced by following the process schematically depicted in FIG. 1. Web 11 is drawn from a storage roll 20 and coated, e.g., between the coating rolls of coater 21 which apply liquid adhesive binder 22 from reservoir 23. The binder coated web is then laid into a liquid curable layer 28 which has been coated by knife coater 27 on carrier belt 26 to form the backing layer and then drawn into flocking station 24 where it is flocked throughout. Alternatively, the binder coated web could be flock coated prior to being laid into the liquid curable layer. The web is then passed through curing oven 29 to cure the adhesive binder and the backing layer and the resultant composite mat rolled to provide a bulk roll 30 for future conversion to smaller sizes. Alternatively, the composite mat could be cut into shorter segments for use instead of being formed into a roll.

Web 11 is sufficiently thick to form a luxuriant underfoot surface. For this purpose, web 11 should be at least 5 mm thick, preferably 10 to 25 mm thick. Web 11 is characterized by having open spaces capable of accepting relatively large amounts of dirt. Such open spaces may be identified by a void volume of at least 75%, preferably from 80% to 90%.

Web 11 is further characterized by being resiliently compressible underfoot by about at least 10% of its thickness. That is, referring to FIG. 2, times 100 the difference between the original thickness ($D_i$) and the compressed thickness ($D_c$) divided by the original thickness ($D_i$), $$\% \text{ Compression } \frac{(D_i - D_c)}{D_i} \times 100,$$

will be at least 10%, preferably 10% to 25% under foot pressure, shoe sole (not heel) pressure, imposed by a pedestrian of average weight, e.g., a man weighing on the order of 64 to 85 kg or a woman weighing on the order of 45 to 60 kg. The term "resiliently compressible" means once compressed under the shoe sole of a pedestrain and within a brief period of time after the compressing force is released, the mat will substantially return to the original thickness.

The web may be any suitable three-dimensional, lofty, open, porous network formed of connected strands or loops of water-resistant, organic polymeric material. The preferred webs are formed of a plurality of autogenously bonded undulated filaments. Such webs are sold under the trade designation "Nomad" by the assignee of the present application and their preparation is described in aforementioned U.S. Pat. No. 3,837,988 (Hennen and Kusilek). Other suitable webs may be provided by crimped staple thermoplastic fibers which are formed in a mat by conventional web-forming equipment such as a "Rando-Webber" device or any other web-forming equipment, adhesive applied in limited quantities to adhere adjacent contacting filaments together at points of mutual contact and curing the resultant web to form a three-dimensional web structure. The filament diameter of the autogenously bonded filaments will generally vary between 0.1 and 3.2 mm, preferably 0.4 to 1.5 mm. The fiber denier of the crimped staple fibers will generally be on the order of 100 to 2000.

Other three-dimensional polymeric structures may be employed to provide the web, provided they have the resilience and compressibility as described above. For example, polymeric webs commercially available generically as "recticulated" webs or webs of open looped pile where the loops are 0.1 to 3.2 mm in diameter and are spaced apart 1.5 to 4 mm and sewn, bonded or otherwise supported on a base layer will also be suitable.

Web 11 is formed of water-resistant, organic polymeric material. The preferred organic materials for forming the web include polyvinyl chloride, polyester such as polyethylene terephthalate, polyurethane, and other polymeric materials capable of being formed into such three-dimensional networks. The preferred web is that formed of polyvinyl chloride according to the disclosure of assignee's U.S. Pat. No. 3,837,988, the disclosure of which is incorporated herein by reference for its description of the method of preparing webs.

The resinous water-resistant bonding adhesive may be any suitable material which has a liquid state and which can be cured to form a water-resistant adherent bond between the surface of the strands of the web and the flock, without unduly altering the fibrous nature of the flock. The cured binder is preferably characterized by being strong, e.g., having a tensile strength of at least $10.4\times10^6$ Pa., and flexible, e.g., having an ultimate elongation of at least 75%. The amount of bonding adhesive applied should be a minimum amount to obtain good adhesion between the web and the flock fibers, yet not so much as to obscure the flock or fill the voids of the web. The amount of binder typically employed may be expressed by the dry weight percent of binder added to the web. Typically, the binder content will be on the order of 10–60%, preferably 20–30%, by weight.

A preferred resinous binding adhesive comprises polyvinyl chloride plastisol containing minor amounts of methylated melamine-formaldehyde resin crosslinking agent. Other useful binders include epoxy resins, polyurethane resins and acrylic resins. In some instances it may be desirable to modify the binder resin by including additives for specific purposes, e.g., to effect better wetting and adhesion to the web.

The flock may be any water-resistant organic textile flocking fiber. The preferred material from which the flock is formed is nylon. Flock formed of cotton, rayon, and other similar materials may also be used. The preferred flock fibers are on the order of 0.5 to 25 denier and have a length of at least about 0.25 mm. The preferred length of the flock will be on the order of 0.25 to 2.5 mm. The flock length and diameter and amount of flock added should be selected so as to avoid excessive filling of the void spaces of the web.

The backing layer may be any suitable continuous sheet of organic polymeric material which could be a solid, an open cell foam, a closed cell foam or combinations thereof. The backing layer could be a preformed sheet of polymeric material such as polyethylene terephthalate, polypropylene, polyethylene and the like. The backing layer preferably is prepared in situ, as shown in FIG. 1 of the drawing, wherein a liquid curable layer is applied to one side of the web to produce a continuous preferably smooth-surfaced layer. The coatable composition should be sufficiently viscous so that it does not penetrate significantly within the body of the flocked web. Rather, the web should merely rest upon one side of the coatable composition applied to form the backing with very slight penetration sufficient to promote, when cured, good adhesion with the web. A preferred backing is formed of a filled vinyl plastisol coating composition which is coated on a carrier belt and the back side of the web laid into the coating composition employing conventional coating techniques. The coating, when cured, produces a structure which provides a good supporting surface to the composite mat.

Any of a variety of coating techniques may be employed to apply the resinous water-resistant bonding adhesive to the web, including, for example, spray coating, dip coating, roll coating and the like.

The flocking may be applied by employing any conventional flocking device including an electrostatic or mechanical flocking device such as the mechanical flocking device sold under the trade designation "Celco" pneumatic flock applicator from Cellusuede Products, Inc. Electrostatic flocking devices produce an electrostatic field between a positive and a negative electrode to furnish the forces of attraction for the flock. The textile flock fibers are fed into and charged in the electrostatic field to where they are aligned and propelled at a high velocity to penetrate the adhesive coating of the web beneath which is a grounded electrode. This provides a uniform distribution of oriented textile flock fibers. Such electrostatic flocking devices may be utilized in conjunction with beater bars which may serve as a grounding electrode to mechanically agitate the web to obtain a more complete fiber distribution throughout the web. The production equipment may also include means for removing excess flock fibers, e.g., a vacuum system.

After leaving the flocking station, the flocked web is passed through a curing oven to cure the adhesive binder. The curing oven is heated to a temperature which will cure the binder resin and permanently adhere the flock to the web surface.

EXAMPLE 1

A web was prepared by extruding the plasticized polyvinyl chloride containing 57.1% of medium molecular weight polymer and 42.9% monomeric phthalate plasticizer together with small amounts of stabilizers and other modifiers according to aforementioned U.S. Pat. No. 3,837,988.The polymer was extruded at a pressure of about $6.9\times10^6$ Pa. through a 500 mm long spinnerette having 640 holes 5 mm in diameter arranged in four equal rows spaced 0.5 mm apart. The spinnerette was heated to about 175° C. and positioned about 200 mm above the surface of a 660 mm wide, 915 mm long, 215 mm deep water quench bath being flushed with 15°–20° C. water at the rate of $7.5\times10^{-5}$ $m^3/s$. Dioctyl sodium sulfosuccinate wetting agent was pumped into a quench tank at a rate sufficient to maintain a concentration of 0.5% thereof in the quench tank. A 125 mm diameter, 560 mm long spiked roll having 1.9 mm diameter 2.4 mm high cylindrical spikes spaced 25 mm apart, arranged in longitudinal rows with 25 mm between rows, with the spikes in adjacent rows staggered 12 mm, was positioned in the bath wlth its axis of rotation at liquid level, and was rotated at a surface speed of $6\times10^{-2}$ m/s. Polymer was extruded at the rate of $4.1\times10^{-2}$ kg/s, producing filaments from each hole at the rate of $7.9\times10^{-2}$ m/s, forming a bundle of filaments consisting of four parallel rows. The extrusion die was positioned with respect to the spiked roll so that one of the rows of filaments contacted the roll surface prior to quenching, producing a lofty open 14 mm thick web having a flat surface and void volume of 90%. The web weighed approximately 1.3 $kg/m^2$ and the filaments measured 0.4–0.5 mm in diameter.

The filaments were autogenously bonded together sufficiently so that the web could easily be removed from the quench bath, dried, and subjected to a reasonable degree of handling without filament separation.

The web was roll coated to provide a dry coating weight of 0.4 $kg/m^2$ with a liquid polyvinyl chloride plastisol containing the following ingredients:

| Ingredient | Generic Designation | Trade Designation | Parts/100 Resin |
|---|---|---|---|
| Resin | Vinyl chloride vinyl | "Diamond" 7401 available | |

-continued

| Ingredient | Generic Designation | Trade Designation | Parts/100 Resin |
|---|---|---|---|
| | acetate copolymer (bulk density 240-310 kg/m$^3$) | from Diamond Shamrock Corp. | 100 |
| Plasticizer | Mixed ester phthalate plasticizer | "Santicizer" 711 available from Monsanto Chemical | 75 |
| Stabilizer | Epoxidized linseed oil | "Drapex" 10.4 available from Argus Chemical Corp. | 5 |
| Stabilizer | Cadmium barium organo salt | "Mark" LL available from Argus Chemical Corp. | 3 |
| Fungicide | 10,10'-oxybisphenoxarsine (10% in epoxidized soybean oil) | "Vinyzene" BP-5-2 available from Ventron Corp. | 2 |
| Adhesion Promoter | Methylated melamine-formaldehyde resin cross-linker | "Cymel" 380 available from American Cyanamid Co. | 13 |

Nylon-6, 6 flock fibers (1 to 6 denier and 0.12 mm to 0.75 mm) were flocked onto the adhesive coated web using an "Indev" 650 mm flock machine. The flock fiber, after being conveyed to two feed hoppers, was (with the aid of brushes) sifted through screens having openings 2.4 mm in diameter, and permitted to fall onto the surface of the plastisol coated web wherein it was dispersed with the aid of beater bars turning at 280 rpm. About 120 grams/m$^2$ flock fibers were retained with nearly a uniform distribution throughout the web.

The flock coated web was then laminated to a conventional polyvinyl chloride plastisol backing containing 26.2% of medium molecular weight polymer, 31.4% mixed ester phthalate plasticizer and 42% calcium carbonate filler together with small amounts of stabilizers, colorants and other additives. After mixing the ingredients of polyvinyl chloride plastisol, the liquid plastisol was applied with a doctor blade on a releasable surface in uniform layers 1.1 mm thick and 500 mm wide. After curing by heating at about 160° C. for 10 minutes, the plastisol coating and backing were solidified.

The resulting web, which weighed about 3.15 kg/m$^2$ and was 13 mm thick, was cut into mats which were characterized by being water absorbing, easily cleaned, flexible and conformable, durable, carpet-like, crush resistant, resilient, and provided a functional, yet luxuriant underfoot mat.

EXAMPLE 2

A lofty open non-woven web was made from 200 denier polyester crimped 50 mm long staple fiber having 8-10 crimps per 25 mm. The web was air formed using a Rando-Webber machine. The resultant unbonded non-woven web weighed 205-220 grams per m$^2$. The web was bonded by roll coating on the following adhesive:

| Ingredient | Parts by Weight |
|---|---|
| Ketoxime-blocked poly-1,4-butylene glycol diisocyanate having a molecular weight of about 1500 (sold under the trade designation "Adiprene" BL-16) | 100.0 |
| Methylene dianiline | 33.3 |
| 2-ethoxyethyl acetate solvent $CH_3COO(CH_2)_2OH$ | 95.1 |

The web adhesive coated non-woven web was coated with flock fibers as described in Example 1 and cured at 150° C. for 20 minutes. Dry adhesive coating weight was 215 g/m$^2$ and the flock coating weight was 100 g/m$^2$.

A plastisol backing was applied as described in Example 1.

EXAMPLES 3-6

Mats were prepared as in Example 1 with the exception that the amount of flock fiber was varied and no plastisol solid backing was formed onto the webs. These mats were evaluated to determine the amount of water retained. Results are reported below:

| Example | Flocked Fiber Weight g/m$^2$ | Water Retained Grams |
|---|---|---|
| 3 | 180 | 11 |
| 4 | 120 | 8 |
| 5 | 50 | 5 |
| 6 | 0 | 3 |

The following procedure was used to measure the water retained in these web structures.

Preweighed 102×152 mm samples of the webs were soaked for 15 minutes in water containing 0.1% sodium lauryl sulfate wetting agent. The samples were then removed and attached to the inside of a cylinder 355 mm diameter 203 mm long made from a screen having 6 mm square mesh. The cylinder, vertically oriented, was rotated at 230 rpm for 45 seconds. The samples were removed, weighed and water retained calculated.

EXAMPLE 7

A mat was made as described in Example 1 with the exception that 2 denier and 0.125 to 0.75 mm long rayon flock fibers were used. The resultant mat performed in a similar manner to the mat of Example 1.

EXAMPLES 8-13

The flocked webs were made as described in Example 1 with the exception of the flock which is described below:

| Ex. | Type | Denier | Length (mm) | Comments |
|---|---|---|---|---|
| 8 | Nylon-6,6 | 6 | 3.0 | Flock too long - not possible to flock into web |
| 9 | Nylon-6,6 | 6 | 2.2 | Flock somewhat too long - flock penetrated only 30-40% of web thickness |
| 10 | Nylon-6,6 | 3 | 0.76 | Flocks well, uniform coating throughout web thickness |
| 11 | Nylon-6,6 | 30 | 3.0 | Flock too long - did not flock well only 40% penetration |

-continued

| Ex. | Type | Denier | Length (mm) | Comments |
|---|---|---|---|---|
| 12 | Nylon-6,6 | 18 | 0.76 | Flocked well. 100% penetration |
| 13 | Rayon | 2 | 0.76 | Flocked well, an excellent mat |

EXAMPLE 14

An open cell flexible polyurethane foam material having 10 pores per lineal 25 mm, a density of $6\times10^{-3}$ kg/m$^3$ was coated with the polyvinyl chloride plastisol adhesive mixture as described in Example 1.

The plastisol coated foam was then coated with flock as described in Example 1 and cured at 165° C. for 10 minutes. The foam contained 240 g/m$^2$ dry adhesive and 48 g/m$^2$ flock fiber. A plastisol backing was applied as in Example 1. The resultant web was cut into a mat and performed adequately as a walk-off mat.

I claim:

1. A flocked mat especially suited for pedestrain traffic particularly to wipe wet and/or dirty feet, said mat comprising:

(1) a web formed of a three-dimensional, lofty, open, porous, network comprising strands of water-resistant, organic polymer material generally defining connecting open spaces capable of receiving dirt, said web being at least 0.5 cm in thickness, having a void volume of at least about 75% and being resiliently compressible underfoot by about at least 10% of its thickness;

(2) a continuous backing layer of organic polymeric material having a thickness on the order of 0.2 to 2.5 mm attached to one major surface of said web and forming one major surface of said mat;

(3) a resinous water-resistant bonding adhesive substantially entirely coating the surfaces of said strands of said network without filling said open spaces substantially throughout said web; and (4) water-resistant, wear-resistant organic textile flocking material having a denier in the range of about 0.5 to 25 and a length in the range of about 0.25 to 2.5 mm and being uniformly distributed substantially throughout said web and adhesively bonded to said web by said resinous bonding adhesive substantially entirely covering the surfaces of each of said strands of said network substantially without filling said open spaces to provide a flocked web capable of providing a wiping surface for dirt and water, receiving, obscuring and holding dirt therein and facilitating the evaporation of water.

2. The mat of claim 1 wherein said three-dimensional web is a recticulated foam.

3. The mat of claim 1 wherein said three-dimensional web is formed of a multiplicity of continuous undulated filaments autogenously bonded together at points of mutual contact.

4. The mat of claim 3 wherein said web of undulated filaments has a greater filament density adjacent said backing layer than in the remaining portion of said web.

5. The mat of claim 1 wherein said three-dimensional web is formed of crimped stable fibers adhesively bonded together at points of mutual contact.

6. The mat of claim 1 wherein said three-dimensional web is open looped pile supported by a base layer.

7. The mat of claim 1 wherein said organic polymeric material is selected from the group consisting of polyamide, polyvinylchloride, polyester, polyurethane and polycarbonate.

8. The mat of claim 1 wherein said water-resistant organic textile flocking material is formed from an organic material selected from the group consisting of nylon, rayon, polyester and mixtures thereof.

9. The mat of claim 1 wherein said backing layer comprises a closed cell foam.

10. The mat of claim 1 wherein said backing layer comprises an open cell foam.

11. The mat of claim 1 wherein said backing layer comprises a foam formed of a polymeric material selected from the group consisting of polyurethane, polyvinyl chloride, polyester, polypropylene and polyethylene.

* * * * *